United States Patent [19]

Borda

[11] Patent Number: 4,747,223

[45] Date of Patent: May 31, 1988

[54] MIRRORED COMMUNICATION SYSTEM

[76] Inventor: Cesar Borda, 666 E. Ocean Boulevard #2606, Long Beach, Calif. 90802

[21] Appl. No.: 797,572

[22] Filed: Nov. 13, 1985

[51] Int. Cl.[4] ..... G09F 13/12

[52] U.S. Cl. ..... 40/219; 40/442; 40/900

[58] Field of Search ..... 40/219, 900, 442; 272/8 M

[56] References Cited

U.S. PATENT DOCUMENTS

| | | | |
|---|---|---|---|
| 596,672 | 1/1898 | Wirth | 40/219 |
| 720,877 | 2/1903 | Bloch | 40/219 X |
| 2,069,368 | 4/1937 | Horinstein | 40/219 |
| 2,112,314 | 3/1938 | Spandau | 40/219 |
| 2,118,131 | 5/1938 | Alexander | 40/219 |
| 2,221,889 | 11/1940 | White | 40/219 |
| 2,565,575 | 8/1951 | Rosenthal | 40/219 |
| 2,698,177 | 12/1954 | Engman | 272/8 M |
| 3,256,014 | 6/1966 | Kelsey | 40/219 |
| 3,745,678 | 7/1973 | Thomassen | 40/219 |

FOREIGN PATENT DOCUMENTS 241254 1/1973 Argentina .

*Primary Examiner*—Gene Mancene
*Assistant Examiner*—Wenceslao J. Contreras
*Attorney, Agent, or Firm*—Nilsson, Robbins, Dalgarn, Berliner, Carson & Wurst

[57] ABSTRACT

A partially transparent mirrored screen extends continuously over a preselected area and contains a distribution of reflective material which varies in optical density to define regions of differing optical transmittance to light. A plurality of regions are selectively backlighted to reveal two-dimensional or three-dimensional images embodied within media behind the screen. The densities of the regions are chosen so that the images are displayed clearly when the regions are backlighted and disappear in the absence of backlighting, leaving the screen uniformly reflective of environmental light in an "off" condition. In a preferred embodiment, the reflective material includes a front layer of uniform optical density over the preselected area and a rear layer of nonuniform optical density. The front layer corresponds to the density required for a first object or image-bearing sheet located behind one region of the mirror and the rear layer provides a different density for a sheet located behind another region.

16 Claims, 3 Drawing Sheets

MIRRORED COMMUNICATION SYSTEM

BACKGROUND OF THE INVENTION

The present invention relates to the field of communication and, more particularly, to a device for causing a plurality of images having different optical characteristics to appear through a continuous mirrored screen.

Prior devices for displaying an image through a mirrored surface are described in the following patents: U.S. Pat. No. 569,672 to Wirth; U.S. Pat. No. 720,877 to Bloch; U.S. Pat. No. 2,069,368 to Horinstein; U.S. Pat. No. 2,565,575 to Rosenthal; U.S. Pat. No. 2,698,177 to Engman; and Argentine Pat. No. 193.254, dated Apr. 11, 1973. In such devices, at least one image-bearing transparency or object is located behind a partially transparent mirror of uniform optical density, i.e., a mirror in which transmittance and reflectance are uniform over its surface. The mirrors can be made by any well known mirroring process, such as that involving silver nitrate.

Items displayed through a single, continuous mirror of uniform transmittance must have identical optical properties, including degree of reflectance. It is not possible to display items of different reflectances or physical forms (e.g., two-dimensional transparencies and three-dimensional objects) through a uniform screen because such items require different optical densities to attenuate reflection of environmental light by the items without darkening the images displayed. If the optical properties of the items were different, an item would be visible through the unlighted screen or illuminated to a different intensity than the other items.

The devices of the Wirth, Bloch, Horinstein, Rosenthal and Argentine patents have localized light sources placed directly behind transparencies of two-dimensional images. Such sources provide uneven illumination, detracting from the images displayed and giving rise to "hot spots" which can burn or distort the transparencies.

Therefore, it is desirable in many applications to provide an apparatus for selective display of images having different optical properties within the same mirror, and for illuminating transparencies uniformly without damage to the device or the transparencies.

SUMMARY OF THE INVENTION

The communication system of the present invention comprises: a partially transparent mirror extending continuously over a preselected area and having a distribution of reflective material which varies in optical density over the area to define regions of differing optical transmittance; image-bearing media located behind the mirror at a plurality of those regions; and apparatus for selectively backlighting the regions so that the images contained in the media become visible on the face of the mirror.

In a preferred embodiment, the reflective material includes a front layer of uniform optical density over the preselected area and a rear layer of nonuniform optical density.

In another embodiment, the reflective material includes a first region of a first preselected transmittance and a second region of a second preselected transmittance which is lower than the first transmittance. The images are provided by a three-dimensional object behind the first region and a sheet bearing a two-dimensional image behind the second region. The first and second regions are selectively backlighted by independent lamp structures disposed above and behind the regions and light is directed onto the sheet by a mirror forming an angle of approximately 45 degrees with the sheet.

The apparatus of the invention has a continuous surface which is uniformly reflective in the "off" state yet has regions of different optical densities calculated to permit selective display of different image-bearing materials. Uniform reflectance of environmental light in the "off" state is assured by the uniform front layer of reflective material. Behind that is a rear layer having regions of differing densities.

When a two-dimensional image-bearing sheet or "transparency" is located behind one region of the screen, the back layer at that region is selected so that its optical density combines with that of the front layer to eliminate visible reflection of environmental light by the transparency. Environmental light reflected by the transparency is attenuated enough by the combined optical densities that it is not visible in comparison to the much greater amount of environmental light reflected by the uniform layer nearest the front of the device. At the same time, the combined optical density of reflective material at each region is low enough to allow the images to be displayed clearly when the screen is backlighted. Thus, the optical density of the second layer varies from one region to the next, depending in part on the reflectances of the transparencies.

A region of the screen can be backed by a three-dimensional object in a suitable closed compartment rather than by a transparency. The image displayed when the region is backlighted is then the three-dimensional image of the object. The optical density of the region covering the compartment is sufficient to prevent visible reflection of environmental light by the object in the absence of backlighting, yet is substantially less than that required for a transparency in contact with the screen. In the embodiment that displays both two- and three-dimensional objects, the uniform front layer may have the density required for three-dimensional objects and the remaining layers may have substantially transparent "window" portions at those areas.

Optical density over the surface of the screen is controlled by thin film techniques so that the density at each region is just sufficient to prevent the image behind it from being visible in the absence of backlighting. This permits the integration of a number of regions of different density within a single continuous mirror and enhances the clarity and reproducability of the displayed images. Clear two- and three-dimensional images can be made to appear vividly and instantaneously on a single reflective screen, and to disappear just as fast, according to a predetermined timed program. All common areas and any areas not backlighted are fully reflective of ambient light. The effect is particularly striking when combined with an audio output which is related to the image and is timed in accordance therewith.

BRIEF DESCRIPTION OF THE DRAWINGS

The above and other features of the present invention may be more fully understood from the following detailed description, together with the accompanying drawings, wherein similar reference characters refer to similar elements throughout and in which.

DESCRIPTION OF THE PREFERRED EMBODIMENT

Figure 1:
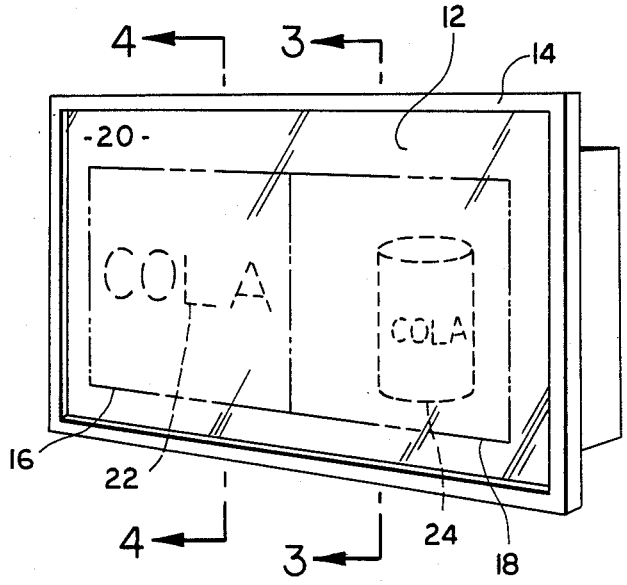
FIG. 1 is a perspective view of a display system constructed according to a preferred embodiment of the invention, with different display fields indicated in phantom lines and sample images shown in broken lines.

FIG. 1 depicts a display system 10 constructed according to a preferred embodiment of the present invention. The system has a continuous mirrored screen 12 which is surrounded by a peripheral frame 14 and defines first and second display fields 16 and 18, respectively. The screen normally reflects environmental light uniformly over an outer surface 20 thereof and reveals a two-dimensional image 22 and a three-dimensional image 24 in response to backlighting of the display fields 16 and 18, respectively. The images are typically revealed in a timed manner and accompanied by a related audio output. In addition, the three-dimensional object may be rotated or otherwise moved as it is displayed.

Uniform reflectance of the screen in the "off" condition is achieved by a first uniform reflective layer at the front surface 20, and differences in optical density required to display two- and three-dimensional images on the same screen are provided by a second reflective layer behind the first layer. The second layer becomes significant only when one of the fields is backlighted. Alternatively, the fields can be used to display two or more images from transparencies or other two-dimensional image-bearing sheets of different optical properties. The second layer of reflective material is then used to "fine tune" the optical density of the screen 12 at locations of the image-bearing sheets so that each image is displayed prominently when it is backlighted but essentially disappears when backlighting ceases.

Figure 3:
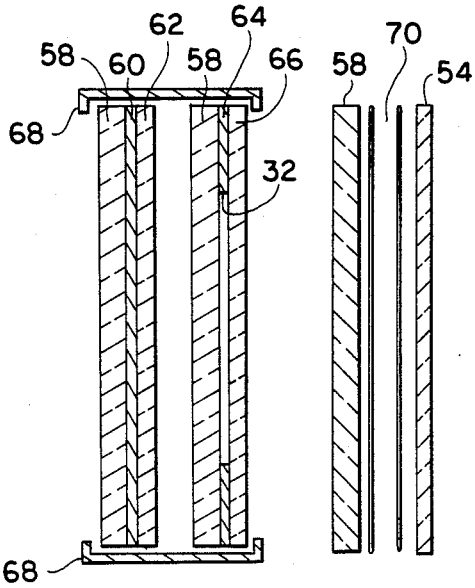
FIG. 3 is an enlarged schematic representation of a cross-section of the front screen of the system, taken along the line 3—3 of FIG. 1.
Figure 2:
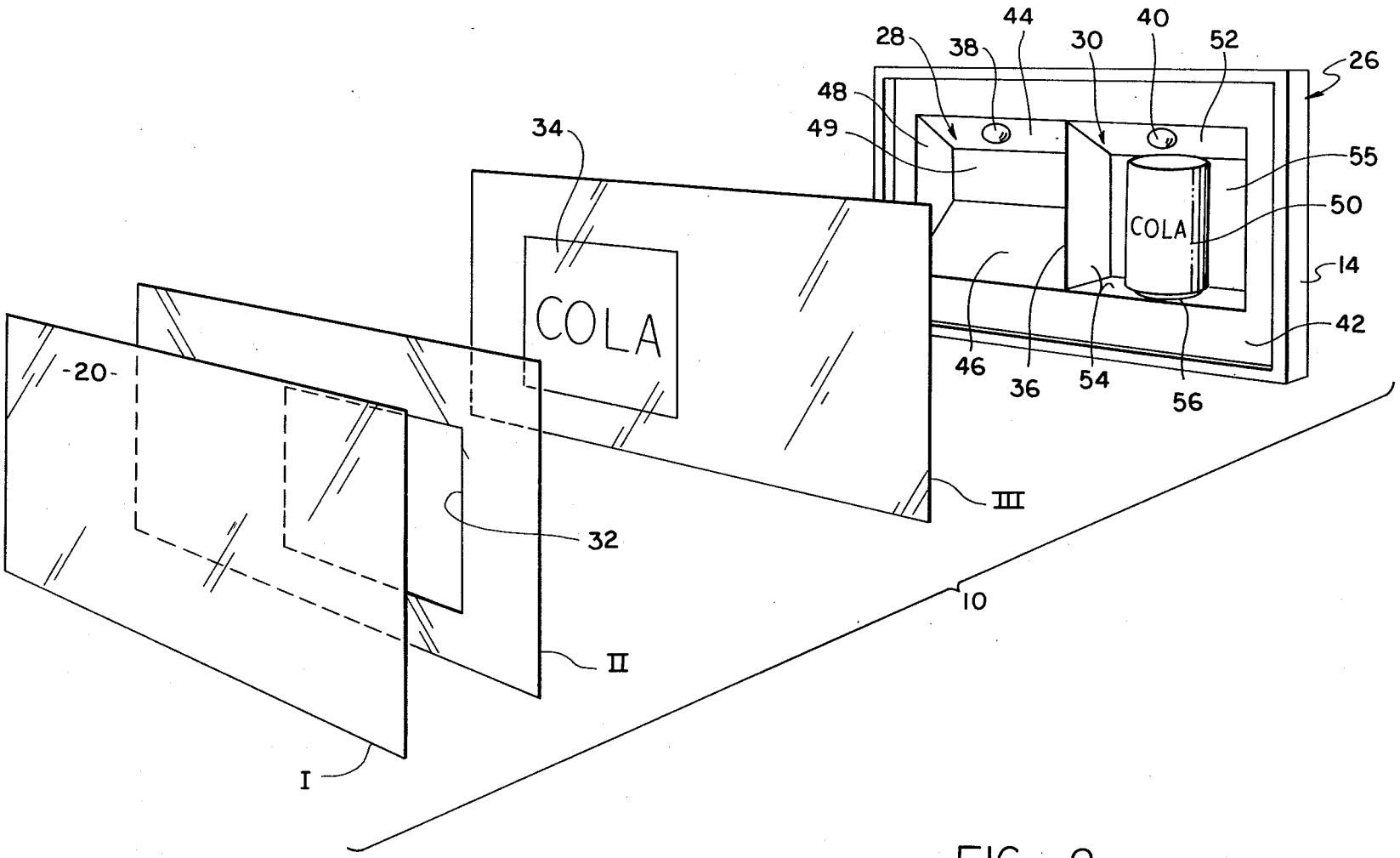
FIG. 2 is an exploded perspective view of the display system of FIG. 1.

Referring now to FIGS. 2 and 3, the preferred embodiment of the mirrored screen 12 is a composite made up of aligned panels I, II and III, superimposed over a housing 26 which defines a first compartment 28 behind the first field 16 and a second compartment 30 behind the second field 18. The panel I is a light transmissive mirror with a uniform optical density which gives rise to a transmittance of something less than 50 percent to light over the visible range. The panel II, another light transmissive mirror, has a "window" portion 32 corresponding to the area of the second field 18 (FIG. 1). The distribution of reflective material over the area of panel II is nonuniform, varying from a very low optical density over the transparent window portion to a greater optical density over the remaining "nonwindow" portion. In the preferred embodiment, the nonwindow portion of panel II has an optical density giving rise to somewhat less than 33% transmittance in the visible range and the window portion is transparent. Panel III, the last of the superimposed panels, carries an image-bearing sheet 34 at a location corresponding to the first field 16 (FIG. 1). Other portions of the panel II are preferably transparent.

As mentioned above, the housing 26 has a first compartment 28 and a second compartment 30 positioned behind the fields 16 and 18, respectively. The compartments are separated by a partition 36 and are provided with lamps 38 and 40 for individual illumination. Outer edges of the compartments are connected to the frame 14 by an opaque border portion 42 which backs up the outer portions of the panels I, II and III.

The first compartment 28 is constructed to illuminate the back of the image-bearing sheet 34 so that light passed by the image-bearing sheet reaches the front surface 20 of the mirrored screen with an intensity sufficient to dominate the reflected image of the environment at the field 16 of the screen. This causes the two-dimensional image 22 of the sheet 34 to appear on the face of the screen when the lamp 38 is lit. The image-bearing sheet is illuminated substantially indirectly by the light 38, which points downwardly from an opaque upper surface 44 of the compartment 28 toward forwardly tilted mirror 46 at the base of the compartment. The remaining interior walls 48 of the compartment are opaque, with the exception of the back wall which is a translucent sheet 49 to minimize reflection of the image. The downwardly directed lamp 38 and the mirror 46 combine to illuminate the image-bearing sheet 34 at acute angles, producing an image of uniform intensity on the mirrored screen 12.

When a two-dimensional image-bearing sheet 34 is positioned behind the display field 16 (FIG. 1), the combined optical density of the panels I and II at that location must be sufficient to prevent visible reflection of environmental light by the image-bearing sheet in the absence of backlighting. Otherwise, the sheet 34 will be visible in the "off" condition and spoil the effect of uniform reflection. By the same token, the combined optical density of the panels I and II should not be greater than that required to prevent environmental reflection by the sheet because any such density would inhibit appearance of the image when the sheet is backlighted.

The second compartment 30 of the housing 26 is different from the first compartment 28 in that it contains an object 50 which is displayed through the mirrored screen 12. The compartment 30 is illuminated by a lamp 40 at an opaque upper surface 52 of the compartment and is surrounded by opaque interior side walls 54. The rear wall of the compartment is lined with a translucent sheet 55 to prevent coherent reflection of light. The object 50 can be rotated on a turntable 56, if desired, to attract attention or display different sides of the object.

The optical requirements for displaying the three-dimensional object 50 are different from those for displaying two-dimensional images because the object is spaced behind the screen. This reduces the reflection of environmental light back through the screen to a point far below the levels encountered with transparencies. Therefore, a lower optical density will block the view of the object through the screen in the "off" condition. In addition, a lower density is required to render an object visible through the mirrored screen because light typically cannot pass through an object as it can a transparency. Only light reflected by the object is available for transmission to an observer. In the disclosed embodiment, the panel I is provided with uniform density which is optimal for display of the object 50, and the panels II and III are transparent over the second field 18.

With reference now to FIG. 3, the thicknesses of the various layers of the panels I, II and III have been exaggerated for clarity. Each of the panels has a rigid transparent sheet 58 which serves as a base or "substrate" of the panel. The sheet 58 of the panel I is backed by a uniform layer 60 of reflective material having an optical density sufficient to prevent the object 50 from being visible in the "off" condition of the apparatus. A flexible transparent coating 62 is applied behind the layer 60 to protect it. A reflective layer 64 on the back surface of the transparent sheet 58 has an optical density which varies over the area of the screen 12.

The layers 60 and 64 combine to establish the optical densities of the first display field 16, the second display field 18, and the areas surrounding the display fields. In the illustrated embodiment, the layer 64 has a uniform optical density over the first display field 16 and the peripheral areas of the mirrored screen 12, and has an optical density of substantially zero at the second field 18 to define the window 32 (FIGS. 2 and 3). The layer 64 is also backed by a flexible transparent coating 66 and the panels I and II are held together by a removable edge seal 68. Thus, the panel II can be replaced with a panel of different optical characteristics to define other display regions or adapt the apparatus to image-bearing materials having different optical properties.

The transparent sheet 58 of the panel III supports the two-dimensional image bearing sheet 34 and retains the object 50 within the second compartment 30 (FIG. 2). Because FIG. 3 is a cross section taken through the second compartment 30, the image-bearing sheet 34 is not visible. Rather, the space containing the object 50 is shown schematically at 70 between the transparent sheet 58 and the translucent sheet 55 at the rear of the compartment 30.

Figure 4:
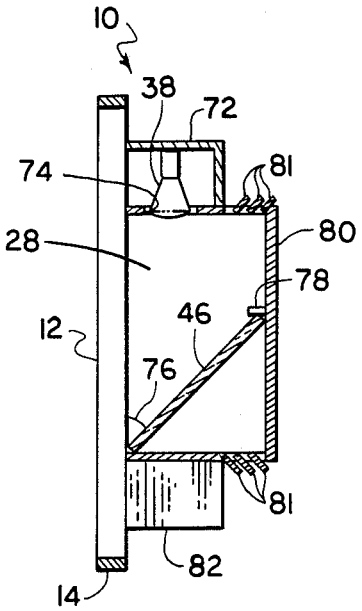
FIG. 4 is a cross-sectional view of the system, taken along the line 4—4 of FIG. 1.

Referring to FIG. 4, which is a cross-sectional view of the housing 26 through the first compartment 28, the lamp 38 is located within a light box 72 above the compartment 28. The lamp directs light downwardly through an opening 74 in the ceiling of the compartment, onto both the screen 12 and the mirror 46. The mirror is directed forwardly and upwardly from the bottom of the box to indirectly illuminate the screen. The mirror preferably makes an angle 76 of approximately 45 degrees with the screen 12 and is held in place at its upper end by a retaining rib 78.

The compartments 28 and 30 are provided with a series of louvers 81 at the upper and lower surfaces thereof to prevent heat damage to the image-bearing sheet 34 and the object 50. As air within the compartments is heated by the lamps, it rises and passes through the upper set of louvers. This draws new air up through the lower set of louvers to cool the compartments.

An audio output and timing subsystem 82 is provided in a separate compartment at the base of the housing 26 to provide accompaniment for and timing of the images 22 and 24 (FIG. 1). The subsystem 82 is designed according to known electronic technology to coordinate the audio and visual outputs of the device in a manner having the greatest possible effect on an observer. In addition, the subsystem 52 may control the motorized turntable 56 (FIG. 2) to rotate the object 50 as it is displayed.

The rigid substrates 58 of the panels I, II and III are preferably crystalline polycarbonate sheets approximately 1/16-inch thick. The substrates 58 of the panels I and III are polished on both surfaces, whereas the substrate 58 of the panel II may be polished on its front surface only. This causes the layer 64 to be less highly reflective than the layer 60, minimizing internal reflection between the panels. The transparent coatings 62 and 66 are preferably crystalline polyethylene having one or two adhesive surfaces, depending upon application. If it is desired to attach panel II to the other panels on a permanent basis, double adhesive sheets are used. The rear sheet 49 of the first compartment 28 and the rear sheet 55 of the second compartment 30 are preferably made of rigid translucent (white) polycarbonate or acrylic sheet stock approximately 1/16-inch thick.

The reflective layers 60 and 64 are deposited by a controllable thin film process, such as vacuum deposition or sputtering, permitting their properties to be controlled precisely. In a preferred embodiment, the layer 60 is a uniform layer of bright chromium or nickel deposited to a thickness of approximately 3900 angstroms at the rear surface of the transparent substrate 58 of the panel I, providing a transmittance of approximately 42 percent over the visible spectrum. This density has been found to mask the object 50 from view and leave the second field 18 (FIG. 1) in a condition of full environmental reflection when the lamp 40 is "off". However, it also permits full visibility of the object 50 when the second field is backlighted.

When the image-bearing sheet 34 is an acetate film, such as a conventional photographic transparency, the layer 64 of the panel II is a layer of grey chromium deposited to a thickness of approximately 4000 angstroms. This provides a light transmittance of approximately 28 percent over the visible spectrum. In conjunction with the 42 percent transmittance of the panel I, it fully masks the image-bearing sheet 34 from view in the "off" condition. The specific example for which these percentages are derived is the photographic film manufactured by Kodak under the trademark Ektachrome. Such film absorbs a significant proportion of the light incident from outside and is not as reflective as other image-bearing substances.

Another possible material for the image-bearing sheet 34 is translucent plastic which has been sensitized for use as a photographic material. Such material is available under the trademark Duratram. It reflects light to a greater deqree than does acetate film. Alternatively, the sheet 34 may be printed paper, which is highly opaque under normal conditions and can have a high reflectance. When a different image-bearing material is used, the reflectance of the material is accounted for by adjusting the optical density of the second panel II.

Figure 5:
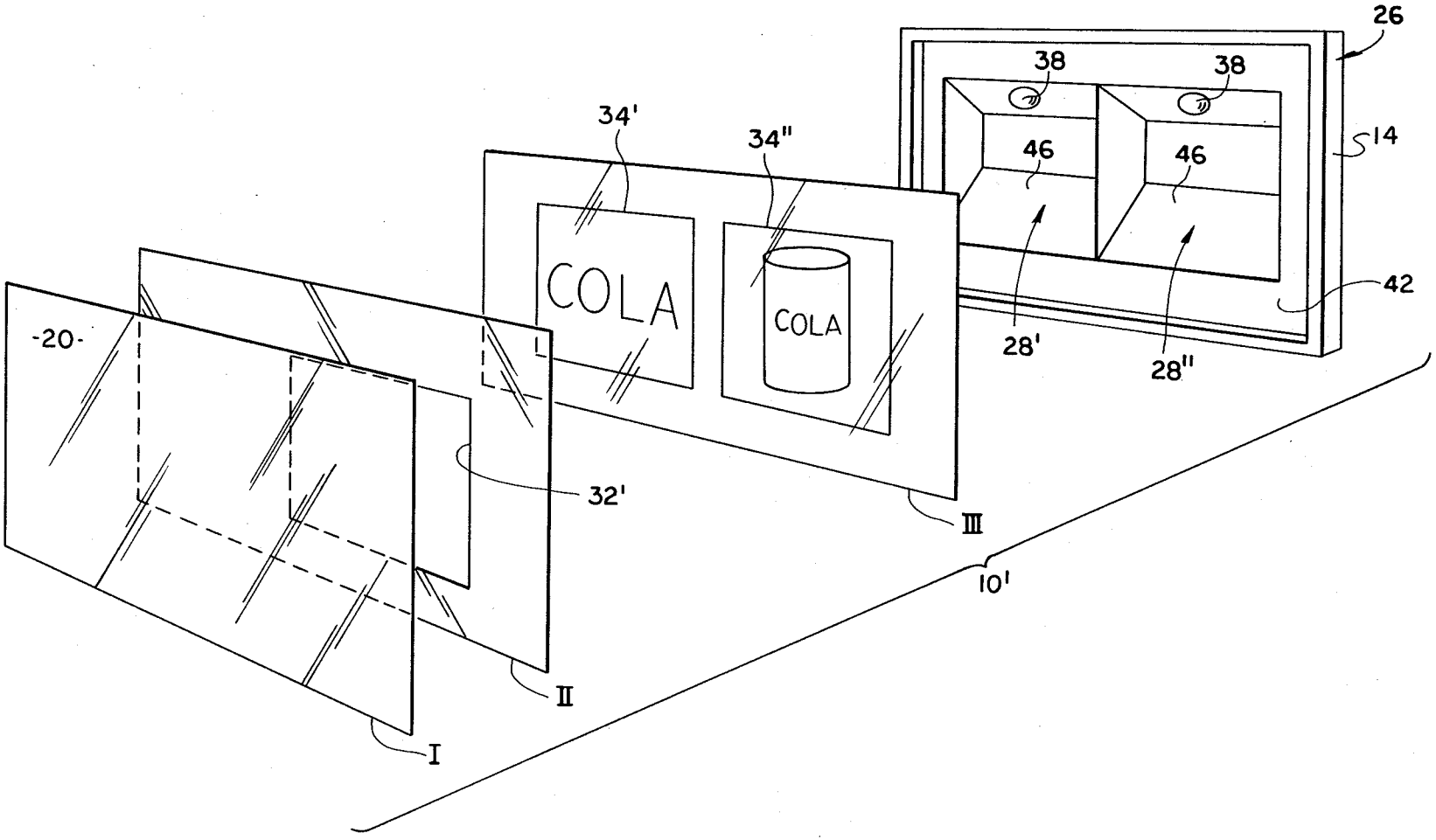
FIG. 5 is an exploded perspective view of a display system constructed according to another preferred embodiment of the invention.

A display apparatus constructed according to another embodiment of the present invention is illustrated in FIG. 5, wherein the panel III contains image-bearing sheets 34' and 34'' of different optical characteristics. For example, one sheet can be a photographic transparency and the other can be a sheet of printed paper. The sheets are placed behind areas of the panel III which correspond to display fields 16 and 17, respectively (FIG. 1). A pair of illumination compartments 28' and 28'', which are similar to the first compartment 28 of the apparatus 10, are provided behind the image-bearing sheets for independent illumination. The panels I and II are identical to those described above, except that the densities of the layers of reflective material are chosen to match the characteristics of the image-bearing sheets and to cause the images of both sheets to be masked when they are not backlighted. The window region 32' may be either a transparent region, as described above in connection with the embodiment 10, or a region having a positive reflectivity less than that of surrounding portions of the panel II.

From the above, it can be seen that there has been provided a system for clearly and independently displaying a plurality of distinct images on a single reflective surface, even if the images are embodied in materials having different optical properties or one image is two-dimensional and the other is three-dimensional. In either case, images appear spontaneously and in a timed fashion on a surface which behaves as an ordinary mirror both before and after each display. Images can be made to move as they are displayed and an audio output can be provided, if desired. The system is highly versatile and has specific utility in the fields of education, advertising and communication.

While certain specific embodiments of the invention have been disclosed as typical, the invention is not limited to these particular forms, but rather is applicable broadly to all such variations as fall within the scope of the appended claims.

What is claimed is:

1. A communication apparatus comprising:

partially transparent mirror means extending continuously over a preselected area and having a distribution of reflective material which varies in optical density over the area to define a plurality of partially transparent regions different from one another in optical transmittance;

means for providing images behind the mirror means at said regions; and means for selectively backlighting said regions so that the images become visible from the front of the mirror means.

2. The communication apparatus of claim 1 wherein:

said distribution of reflective material comprises:

a first layer of uniform optical density over the preselected area; and a second layer of nonuniform optical density over the preselected area, the second layer being located behind the first layer.

3. The communication apparatus of claim 2 wherein:

the mirror means includes a front portion, a back portion and means for holding the front and back portions together; and the front portion has a transparent substrate which is located directly in front of the first layer and carries the first layer in a supporting relationship.

4. The communication apparatus of claim 3 wherein:

the back portion of the mirror means comprises a separate transparent substrate which carries the second layer of nonuniform optical density.

5. The communication apparatus of claim 4 wherein:

the holding means is constructed and arranged to permit replacement of the back portion with another portion having a different optical density.

6. The communication apparatus of claim 1 wherein:

said distribution of reflective material comprises a first region of a first preselected optical transmittance and a second region of a second preselected optical transmittance which is lower than the first transmittance; and the image means comprises an object behind the first region and a light transmissive sheet bearing a two-dimensional image behind the second region.

7. The communication apparatus of claim 6 wherein:

the backlighting means comprises:

lamp means disposed above and behind the image-bearing sheet; and means for reflecting light from the lamp means onto the image-bearing sheet.

8. The communication apparatus of claim 7 wherein:

the backlighting means further comprises walls defining a compartment behind the image-bearing sheet, said compartment having an upper end and a lower end;

the lamp means shines into the compartment; and the upper and lower ends of the compartment are louvered for passage of cooling air upwardly therein.

9. The communication apparatus of claim 7 wherein:

the reflecting means is a substantially flat mirror disposed at an angle of approximately 45 degrees to the image-bearing sheet.

10. The communication apparatus of claim 7 wherein:

the backlighting means further comprises another lamp means disposed substantially above said object; and partition means for separating the lamp means for selective illumination of the image-bearing sheet and the object.

11. The communication apparatus of claim 6 wherein:

said distribution of reflective material further comprises:

a first uniform layer having an optical density which gives rise to said first optical transmittance over the preselected area; and a second layer located behind the first layer, the second layer being substantially transparent over the first region and having an optical density over the second region which yields, in combination with the first layer, said second preselected optical transmittance.

12. The communication apparatus of claim 11 wherein:

said distribution of reflective material further comprises a third region which surrounds the first and second regions and is backed by a substantially opaque member to prevent transmission of light therethrough.

13. The communication apparatus of claim 6 which further comprises:

means for rotating said object while it is backlighted.

14. The communication apparatus of claim 1 wherein:

said distribution of reflective material comprises a first region of a first preselected optical transmittance and a second region of a second preselected optical transmittance which is lower than the first transmittance;

the image means comprises first and second light transmissions sheets bearing two-dimensional images disposed behind the first and second regions, respectively, of the mirror means, said image-bearing sheets comprising materials of different optical properties; and the first and second transmittances are chosen in accordance with the optical properties of the image-bearing sheets so that the images are visible only when the sheets are backlighted.

15. The communication apparatus of claim 14 wherein:

the image-bearing sheets have different reflectances; and the first and second transmittances of the mirror means are chosen to compensate for said reflectances so that the images are visible only when the sheets are backlighted.

16. The communication apparatus of claim 1 which further comprises:

means for providing an audio output corresponding to said images; and means for timing the backlighting of said sheets in accordance with the audio output.

* * * * *